US008434411B2

(12) United States Patent
Daoud et al.

(10) Patent No.: US 8,434,411 B2
(45) Date of Patent: May 7, 2013

(54) CLUSTER EXPLOSIVELY-FORMED PENETRATOR WARHEADS

(75) Inventors: Sami Daoud, Tucson, AZ (US); Thomas R. Berger, Tucson, AZ (US); Michael J. Villeburn, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 198 days.

(21) Appl. No.: 13/009,074

(22) Filed: Jan. 19, 2011

(65) Prior Publication Data

US 2012/0279411 A1 Nov. 8, 2012

(51) Int. Cl.
*F42B 12/06* (2006.01)
*F42B 12/32* (2006.01)
*F42B 12/74* (2006.01)

(52) U.S. Cl.
USPC ..... 102/497; 102/476; 102/482

(58) Field of Classification Search ..... 102/306, 102/310, 475, 476, 480, 482, 497
See application file for complete search history.

(56) References Cited

U.S. PATENT DOCUMENTS

| | | | | | |
|---|---|---|---|---|---|
| 11,901 | A | * | 11/1854 | Miller | 102/480 |
| 21,773 | A | * | 10/1858 | Olmstead | 102/480 |
| 34,302 | A | * | 2/1862 | Jones | 102/480 |
| 34,979 | A | * | 4/1862 | Peters | 102/480 |
| 2,831,429 | A | * | 4/1958 | Moore | 102/307 |
| 3,045,596 | A | * | 7/1962 | Rae | 244/3.11 |
| 3,326,125 | A | * | 6/1967 | Silvia et al. | 102/305 |
| 3,948,181 | A | * | 4/1976 | Bergstrom | 102/476 |
| 4,253,523 | A | * | 3/1981 | Ibsen | 166/299 |
| 4,285,403 | A | * | 8/1981 | Poland | 169/28 |
| 4,458,596 | A | * | 7/1984 | Armstrong | 102/389 |
| 4,649,828 | A | | 3/1987 | Henderson et al. | |
| 4,841,864 | A | | 6/1989 | Grace | |
| 4,942,820 | A | * | 7/1990 | Sawruk | 102/482 |
| H867 | H | | 1/1991 | Hill | |
| 5,038,686 | A | * | 8/1991 | Zulkoski et al. | 102/496 |
| 5,111,746 | A | | 5/1992 | Pentel et al. | |
| 5,191,169 | A | | 3/1993 | Hu | |
| 5,279,228 | A | * | 1/1994 | Ayer | 102/306 |
| 5,341,743 | A | | 8/1994 | Redaud | |
| 5,349,908 | A | | 9/1994 | Walz et al. | |
| 5,540,156 | A | | 7/1996 | Fong | |
| 6,021,716 | A | | 2/2000 | Taylor | |
| 6,152,040 | A | | 11/2000 | Riley et al. | |
| 6,186,070 | B1 | | 2/2001 | Fong et al. | |
| 6,186,072 | B1 | | 2/2001 | Hickerson, Jr. et al. | |
| 6,202,531 | B1 | | 3/2001 | Comeyne | |
| 6,250,229 | B1 | | 6/2001 | Kerdraon et al. | |

(Continued)

FOREIGN PATENT DOCUMENTS

FR 2588950 A1 * 4/1987

OTHER PUBLICATIONS

Machine Translation, Oct. 21, 1985, EPO, 1-5.*

*Primary Examiner* — Bret Hayes
(74) *Attorney, Agent, or Firm* — Cantor Colburn LLP

(57) ABSTRACT

Explosive devices, and in particular cluster explosively-formed penetrator warhead devices, are described herein. In accordance with an exemplary embodiment, a spherically-shaped explosive device comprises an initiator, a fuze component system configured to ignite the initiator, and a substantially spherical explosive charge surrounding the initiator. The substantially spherical explosive charge has a substantially spherical surface. A plurality of liners are on the substantially spherical surface of the substantially spherical explosive charge.

20 Claims, 4 Drawing Sheets

U.S. PATENT DOCUMENTS

| | | | | |
|---|---|---|---|---|
| 6,298,763 | B1 | 10/2001 | Greenfield et al. | |
| 6,308,634 | B1 | 10/2001 | Fong | |
| 6,363,828 | B1 | 4/2002 | Sherlock et al. | |
| 6,393,991 | B1 | 5/2002 | Funston et al. | |
| 6,510,797 | B1 | 1/2003 | Fong | |
| 6,601,517 | B1 | 8/2003 | Guirguis | |
| 6,619,210 | B1 | 9/2003 | Spivak et al. | |
| 6,668,727 | B1 * | 12/2003 | Kim et al. | 102/482 |
| 6,962,113 | B1 | 11/2005 | Carlson et al. | |
| 7,007,607 | B1 | 3/2006 | Fong et al. | |
| 7,104,326 | B2 * | 9/2006 | Grattan et al. | 166/297 |
| 7,150,235 | B1 | 12/2006 | Mikhail | |
| 7,278,354 | B1 | 10/2007 | Langan et al. | |
| 7,418,905 | B2 | 9/2008 | Bootes et al. | |
| 7,437,996 | B2 | 10/2008 | Turner et al. | |
| 7,448,324 | B1 | 11/2008 | King et al. | |
| 2011/0083776 | A1 * | 4/2011 | Daoud et al. | 149/12 |

* cited by examiner

CLUSTER EXPLOSIVELY-FORMED PENETRATOR WARHEADS

FIELD OF THE INVENTION

The present invention generally relates to explosive devices, and more particularly relates to cluster explosively-formed penetrator warheads.

BACKGROUND OF THE INVENTION

Explosively-formed penetrator (EFP) warheads have proven useful against steel and other re-enforced armors. In a conventional single EFP, illustrated in FIG. 1, a main explosive charge 12 proximate to a detonator ignition train 18 is pressed or cast and machined in a steel casing or shell 14 that accommodates a liner 16 having a hemispherical, trumpet, conical or other similar shape. The liner is pressed into a machined cavity of the explosive charge. The liner is made of a highly ductile metal having a high density, such as copper, molybdenum, tungsten, aluminum, or the like. As illustrated in FIG. 2, when the explosive charge 12 is detonated by the detonator ignition train 18, the liner 16 is projected forward as a molten metal elongated slug, referred to as a penetrating jet, that can travel typically at speeds above 9.66 kilometers per second (6 miles per second). The high velocity, high density jet is able to pierce metal armors and other similar re-enforced targets.

Present-day EFP warheads exhibit several drawbacks, however. Some conventional EFP warheads use multiple EFPs that are projected forward in a unidirectional, i.e., single, direction. Accordingly, such EFP warheads are useful against a single armored vehicle. However, where numbers of tanks, vehicles, ships, jets, helicopters, and the like are positioned and/or may be advancing from several directions in a 360 degree battlefield theater, time is critical to the outcome of the battle. The effectiveness of a single or multiple EFPs unidirectionally projected becomes insufficient to gain ground on the battlefield theater.

In addition, having recognized the vulnerability of battlefield armors to high velocity penetrating jets, armor manufacturers have advanced today's battlefield armor design significantly. Through the use of ceramic materials and advanced composites, effectiveness of EFPs has decreased from a lethality standpoint and are much less damaging to an armor.

Accordingly, it is desirable to provide a multidirectional, spherically-shaped explosive device with significantly more lethality and higher destructive effects than conventional warheads. In addition, it is desirable to provide a spherically-shaped explosive device having a plurality of liners that are projected uniformly and radially from a center point of the device upon detonation of the device. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Explosive devices, and in particular cluster explosively-formed penetrator warhead devices, are described herein. In accordance with an exemplary embodiment, a spherically-shaped explosive device comprises an initiator, a fuze component system configured to ignite the initiator, and a substantially spherical explosive charge encasing the initiator. The substantially spherical explosive charge has a substantially spherical surface. A plurality of liners are on the substantially spherical surface of the substantially spherical explosive charge.

In another exemplary embodiment, a cluster explosively-formed penetrator (CEFP) warhead comprises a spherically-shaped explosive charge having a surface comprising a plurality of non-overlapping dimples, a means for detonating the spherically-shaped explosive charge, and a plurality of liners. Each liner is embedded in one of the plurality of non-overlapping dimples.

In a further exemplary embodiment, a warhead comprises an initiator, a fuze component system configured to ignite the initiator, and a spherically-shaped explosive charge encasing the initiator and having a center point. The spherically-shaped explosive charge comprises a PBX composition comprising octanitrocubane homogeneously dispersed within a binder matrix. A booster charge is interposed between the initiator and the spherically-shaped explosive charge. A plurality of non-overlapping liners is on the spherically-shaped explosive charge. Each of the plurality of non-overlapping liners has a central axis that extends through the center point of the spherically-shaped explosive charge.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The various embodiments contemplated herein relate to spherically-shaped explosive devices that exhibit superior explosive output and thus, upon detonation, are capable of projecting liners or penetrators in a three-dimensional direction. In particular, various embodiments contemplated herein are directed to cluster explosively-formed penetrator (CEFP)

warheads having a number of liners on a spherically-shaped explosive charge. Upon detonated, the explosive charge projects the liners, at hypervelocity, in three-dimensions. The liners are positioned on the warhead with a central axis that runs through the center point of the warhead. The lines are of such a size and are uniquely offset from each other so that, upon detonation of the warhead, each travels upon a unique forward path. As the liners travel at hypervelocity, they invert and collapse upon their axes to become high kinetic energy slugs or penetrators of molten metal. (The terms liner and penetrator will be used herein interchangeably.) Such shaped devices are effective penetrators of targets formed from single or multiple layers of materials such as rolled steel armor. Because the the penetrators are projected at hypervelocity in a 360 degree direction, the penetrators can pierce armors of land, air, and sea vehicles substantially simultaneously.

Figure 1:
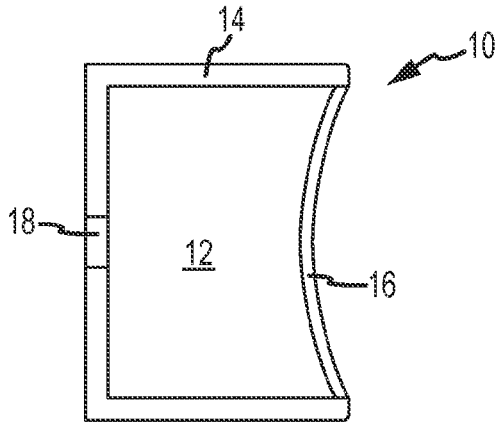
FIG.1 (PRIOR ART)
FIG. 1 is a cross-sectional view of a conventional explosively-formed penetrator (EFP)
Figure 2:
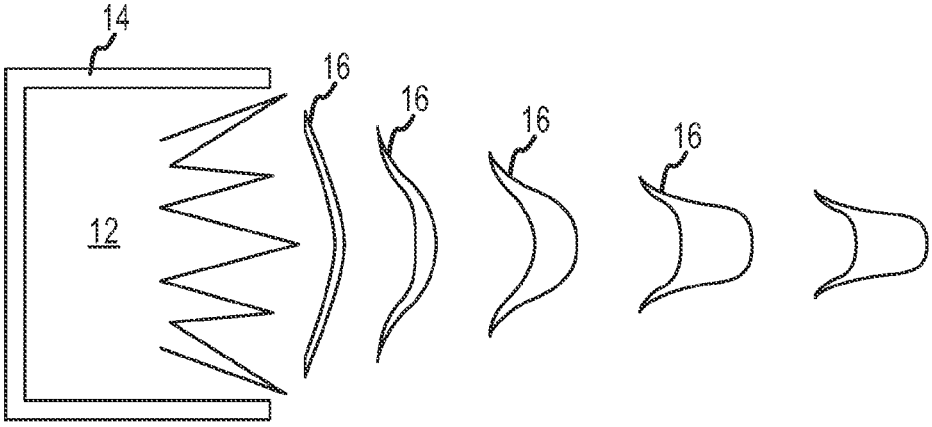
FIG.2 (PRIOR ART)
FIG. 2 is a cross-sectional view of the EFP of FIG. 1 during phases of detonation, formation of a slug and travel of the slug in a unidirectional path.
Figure 3:
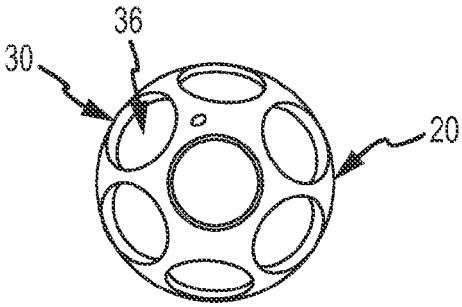
FIG. 3 is a perspective view of a cluster explosively-formed penetrator (CEFP) warhead in accordance with an exemplary embodiment.
Figure 4:
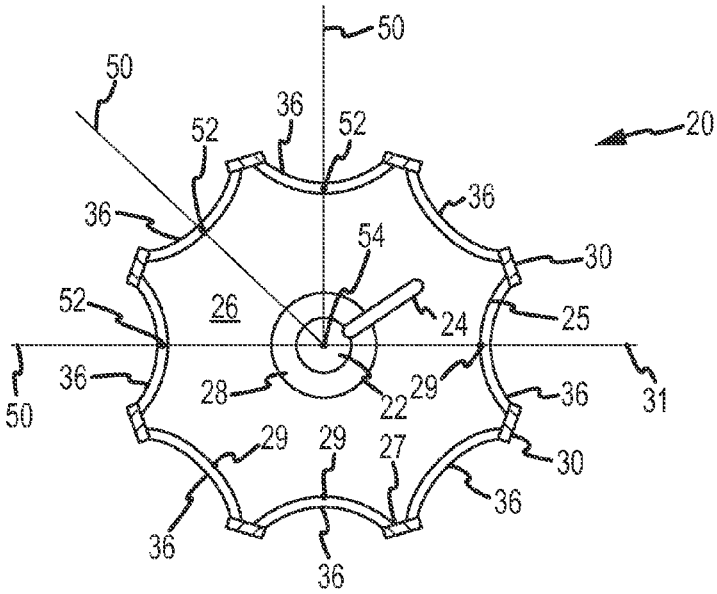
FIG. 4 is a cross-sectional view of the CEFP warhead of FIG. 3.

Referring to FIGS. 3 and 4, in accordance with an exemplary embodiment, a CEFP warhead 20 comprises an ignition train of at least one initiator 22. The initiator 22 may comprise azide-based explosives such as lead azide and lead styphnate, lead picrate, mercury fulminate, zirconium potassium perchlorate (ZPP) and derivatives thereof, thermite, combinations thereof, and the like. In a preferred embodiment, the initiator comprises an insensitive munition-type (IM) explosive material of cis-bis-(5-nitrotetrazolato) tetramine cobalt (III) perchlorate (hereinafter "BNCP"), also referred to as Bis, nitro-cobalt-III-perchlorate, particles, and desensitized BNCP, essentially BNCP that is encapsulated by a surfactant. Explosives with IM properties are capable of withstanding sympathetic detonation as a result of mechanical shocks, fire, electrostatic discharge, and impact by shrapnel, yet is still capable of high-order detonation per design intent. Explosive materials comprising surfactant-encapsulated BNCP particles and methods for manufacturing the explosive materials are disclosed in U.S. patent application Ser. No. 12/636,935 filed Dec. 14, 2009 by the same inventors of the inventions disclosed herein.

A fuze component system 24 is physically and/or electrically coupled to the initiator 22 and comprises a fuze to ignite the initiator upon receiving a signal. The signal can be transmitted to the fuze component system via radio or electromagnetic waves from a transmitter located remote from the CEFP warhead and can be received by a receiver within the CEFP warhead within or outside of the fuse component system. The fuze component system may include a sensor (not shown) such as, for example, a height-of-burst sensor, an acceleration-deceleration sensor, an impact sensor, a pressure sensor, a time delay sensor, a heat sensor, an optical sensor, a microelectromechanical (MEMs) sensor, or a combination thereof, that can activate the fuze component system 24 to ignite the fuze. The sensor can be configured to provide the signal to the fuze component system 24 based upon acceleration, height, barometric pressure, electronic, or dynamic movement of the CEFP warhead 20, a predetermined time or time period, distance from a target, or a combination thereof. For example, the sensor may be able to sense the distance the CEFP warhead is from the ground or from an object/target on the ground and, thus, transmit a signal to the fuze component system 24 that activates the initiator 22 so that the CEFP warhead detonates at predetermined distances from enemy tanks, vehicles, missile launchers, mine fields, etc., on the ground, bunkers, enemy aircrafts, helicopters, etc., in the air, and/or submarines, boats, aircraft carriers, underwater mine fields, etc., in the water. While CEFP warhead 20 is shown in FIG. 4 with one fuze component system 24, it will be appreciated that CEFP warhead 20 may comprise multiple fuze components systems 24 for igniting initiator charge 22.

In an optional embodiment, a secondary explosive, or booster, charge 28 may encase the initiator 22 by being cast about the initiator 22 and, in turn, is encased by a main explosive charge having IM properties. The booster charge may comprise materials such as PBXN-5, PBXN-7, PBXN-9, CH-6, and the like. The CEFP warhead 20 is detonated when the initiator 22 is ignited by the fuze component system 24, generating a shock wave in the booster charge 28 that detonates the main explosive charge 26. In other embodiments, such as when the initiator 22 is sufficiently brisant, a booster charge 28 may not be necessary and the initiator 22 may be used to detonated the main explosive charge 26.

The initiator 22, and the booster charge 28 if present, is encased by the substantially spherically-shaped main explosive charge 26 that is detonated upon ignition of the initiator 22. A substantially spherical surface 27 of the main explosive charge 26 has a plurality of recessed and concave cavities or dimples 25 that have been formed thereon. Each dimple has a center point 29 and an axis 31 that extends through the center point 29 and to a center point 54 of the CEFP warhead 20. Each axis 31 of the dimples 25 only intersect at center point 54. Further, the dimples are of such a size, to be discussed in further detail below with respect to liners 36, that they do not overlap.

In one exemplary embodiment, the main explosive charge 26 is a plastic-bonded explosive, also called a PBX or a polymer-bonded explosive. A PBX generally contains an energetic fuel or "oxidizer" homogeneously dispersed in a matrix of a synthetic thermoset or thermoplastic polymer commonly referred to as a "binder matrix". In this form, the PBX is a high output explosive and may be formulated to exhibit IM properties. Conventional PBXs typically comprise oxidizers such as HMX (or "high melting point explosive"), chemically known as cyclotetramethylene tetranitramine, RDX (or "royal demolition explosive"), chemically known as cyclotrimethylene trinitramine, C1-20, chemically known as 2,4,6,8,10,12-hexanitro-2,4,6,8,10,12-hexaazaisowurtzitane, TATB, chemically known as triaminotrinitrobenzene (also using IUPAC designation, 3,5-triamino-2,4,6-trinitrobenze), FOX-7, also known as 1,1-diamino-2,2-dinitroethene (DADNE), or combinations thereof.

Figure 5:
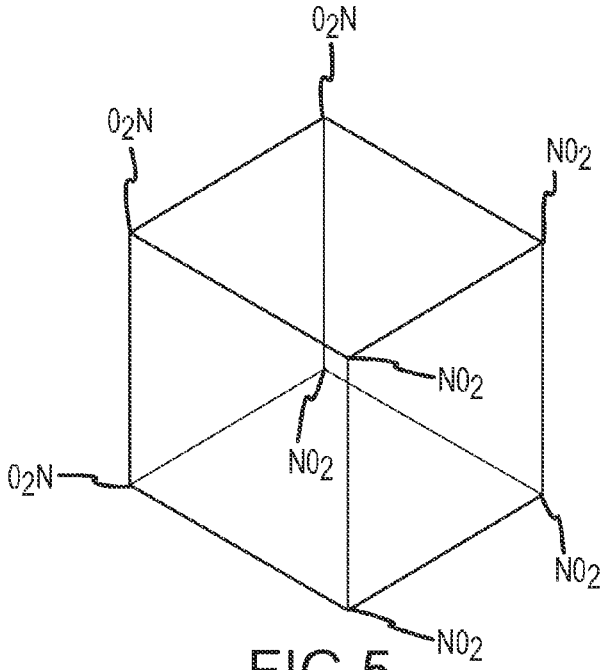
FIG. 5 is a schematic illustration of the molecular structure of octanitrocubane (ONC)

In a preferred embodiment, the main explosive charge 26 is a PBX composition having an oxidizer comprising octanitrocubane (ONC) homogeneously and intimately dispersed within a binder matrix. ONC has the empirical formula $C_8N_8O_{16}$ and the structure illustrated in FIG. 5. The heat of formation of ONC is about +163 kilocalories per mole (Kcal/mole) and the theoretical density of ONC is in the range of about 1.92 to about 2.2 g/cm$^3$. Important factors in determining explosive output are the heat of formation and the theoretical density, as the Velocity of Detonation (VOD) is directly proportional to the square of the theoretical density and the detonation pressure ($P_{CJ}$) is proportional to the theoretical density. ONC is extremely insensitive and considered as the most powerful non-nuclear explosive with superior energy density compared to HMX (theoretical density of 1.86-1.91 grams per cubic centimeter (g/cm$^3$)), RDX (theoretical density of 1.80-1.82 g/cm$^3$), and C1-20 (theoretical density of 1.90-2.04 g/cm$^3$). In this regard, an ONC-based PBX composition comprising ONC and a thermoset resin or high-temperature, high-performance thermoplastic elastomer has a VOD of about 9-11 kilometers per second (km/s), which is about 11-23% greater than that of a comparable HMX-based composition (about 8.5-9.8 km/s). Further, an ONC-based PBX composition has a $P_{CJ}$ of about 465-625 kilobars, about 34% greater than the $P_{CJ}$ of a comparable HMX-based PBX composition (about 396.3 kilobars).

ONC has a zero "oxygen balance" and therefore is capable of complete combustion in the absence of air under ideal conditions. "Oxygen balance" is a ratio of the amount of oxygen in an explosive to the amount of oxygen needed for complete combustion, which dictates the extent of the combustion reaction and the composition of the by-products of the combustion or detonation. The fewer solid byproducts and the more moles of gas produced during combustion of an explosive, the greater the detonation pressure of the explosive. When synthesized stoichiometrically, ONC is a solid, white, granular powder that decomposes upon melting at a temperature of about 297° C. according to the following reaction scheme:

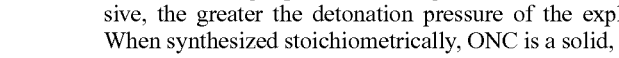

$$C_8(NO_2)_8 \rightarrow 8CO_2 + 4N_2,\ \Delta H + 163\ \text{Kcal/mole}.$$

Thus, because the byproducts of the combustion of ONC are carbon dioxide and nitrogen gases, and because of ONC's high positive heat of formation, ONC has superior detonation output compared to prior art explosives. In addition, ONC is markedly insensitive to shock, impact and electrostatic discharge and is thermally-stable when formulated into the PBX composition using temperatures of up to 350° C. In one exemplary embodiment, the PBX composition comprises ONC oxidizer in the range of about 80 to about 98 weight percent (wt. %) of the PBX composition.

The ONC is mixed and distributed homogenously throughout the binder matrix of the PBX composition and can be present in the PBX composition in one or various particle sizes. For example, in one embodiment, ONC is present as particles with substantially the same dimensions or sizes. In a second embodiment, the ONC is bimodal, having, for example, a blend of coarse ONC particles with a particle size distribution of about 150 to about 400 micrometers (μm) and fine particles with a particle size distribution of about 15 to about 45 μm. In a third embodiment, the ONC is bimodal, having a blend of coarse and fine particles in the ratio of about 5:2, respectively. In a fourth embodiment, the ONC is trimodal, having, for example, a blend of coarse ONC particles with a particle size distribution of about 150 to about 400 μm, fine particles with a particle size distribution of about 15 to about 45 μm, and ultrafine particles with a particle size distribution of about 1 to about 15 μm. In a fifth embodiment, the ONC is trimodal, having a blend of coarse, fine, and ultrafine particles in the ratio of about 5:3:2, respectively. Of course, the ONC particles may be present in any other sizes and size distributions suitable for a particular explosives application.

Depending on a desired explosives application, in addition to ONC, the oxidizer of the PBX composition may also comprise other oxidizers, such as TATB, DADNE, HMX, RDX, C1-20, or combinations thereof. For example, in various explosives applications, it may be desirable to combine oxidizers that impart different characteristics, namely, ballistics properties coupled with mechanical properties, mechanical properties coupled with ease of processing properties, or consolidation characteristics coupled with particle size and hardness properties, etc. Alternatively, in other various explosives applications, it may be desirable to minimize cost of the PBX composition by using an oxidizing component that can be purchased at a lower price than ONC. Most desirably, a PBX composition that imparts the highest IM properties and the highest explosive output is used. Thus, a preferred embodiment comprises ONC, TATB, DADNE, HMX, C1-20, or combinations thereof. In one embodiment, the oxidizer may comprise from about 5 to about 95 wt. % ONC and from about 95 to about 5 wt. % HMX. In a second embodiment, the oxidizer may comprise from about 5 to about 95 wt. % ONC and from about 95 to about 5 wt. % C1-20. In a third embodiment, the oxidizer may comprise from about 5 to about 95 wt. % ONC and from about 95 to about 5 wt. % RDX. In a fourth embodiment, the oxidizer may comprise from about 5 to about 95 wt. % ONC and from about 95 to about 5 wt. % aluminum. In a fifth embodiment, the oxidizer may comprise from about 5 to about 95 wt. % ONC and from about 95 go about 5 wt. % TATB. In a sixth embodiment, the oxidizer may comprise from about 5 to about 95 wt. % ONC and from about 95 to about 5 wt. % DADNE. In a seventh embodiment, the oxidizer may comprise from about 5 to about 5 wt. % ONC and from about 95 to about 5 wt. % of any combination of TATB, DADNE, HMX, RDX, C1-20, aluminum, and/or other oxidizers.

The various embodiments of the PBX composition also contain a binder matrix comprised of a thermoset synthetic resin or a high-temperature, high-performance thermoplastic synthetic elastomer. The binder matrix, in addition to allowing the PBX composition to be manipulated during fabrication into various shapes and forms, also serves as a desensitizer and a fuel for the detonation of the PBX composition. The binder matrix is the backbone component used in the PBX composition, as it provides the skeletal structure for the explosive charge upon which the remaining constituents reside. The binder matrix can comprise energetic or inert synthetic resins. Examples of inert synthetic resins suitable for use in various embodiments of the PBX composition include, but are not limited to, polysulfone (PS), polyether sulfone (PES), polyphenyl sulfone (PPS), polyphenylene sulfide, Viton® fluoroelastomer available from DuPont Performance Polymers of Wilmington, Del., PTFE and other fluoropolymers, polyaryl ketones, such as polyetherether ketone (PEEK), polyetherketone (PEK), and polyetherketoneketone (PEKK), polyisobutylene (PIB), hydroxyl-terminated polybutadiene (HTPB), carboxyl-terminated polybutadiene (CTPB), polybutadiene-acrylic acid-acrylonitrile (PBAN), polyurethanes, polyesters, polyimides, cellulose acetate (CA), cellulose acetate butyrate (CAB), ethylene vinyl acetate (EVA), and combinations thereof. Examples of energetic synthetic resins suitable for use in various embodiments of the PBX composition include, but are not limited to, glacidyl azide polymer (GAP), nitropolyurethanes, nitrocellulose, polyvinyl nitrate, and combinations thereof. In one preferred embodiment, the synthetic resin comprises polyisobutylene (PIB). In another preferred embodiment, the PBX composition comprises a synthetic resin in an amount of from about 2 to about 20 wt. % of the PBX composition. ONC-comprising PBX materials and methods for manufacturing the compositions are disclosed in U.S. patent application Ser. No. 12/579,202 filed Oct. 14, 2009 by the same inventors of the CEFP warheads contemplated herein.

A spherical case or housing 30 comprising a rigid, hollow sphere contains the main explosive charge 26 and the ignition train comprising the fuze component system 24, the initiator 22, and the booster charge 28. The housing may be fabricated from a metal, such as steel or aluminum, or any other suitable structural composite, such as a carbon fiber composite. The housing comprises a number of circular openings 32. The openings 32 may be but are not necessarily spaced equidistance from each other across a surface 34 of the housing 30. The circular openings may be all of the same diameter or may have various diametric openings, optimally spaced without overlapping and in a manner that imparts most effective functionality of the liners, without compromising performance or reliability.

Figure 6:
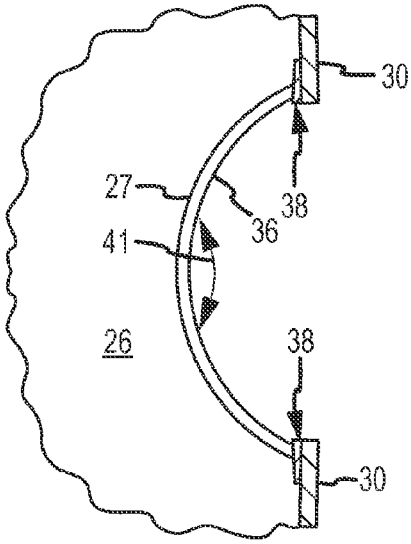
FIG. 6 is a close-up cross-sectional view of a liner of the CEFP warhead of FIG. 3 in accordance with an exemplary embodiment.
Figure 7:
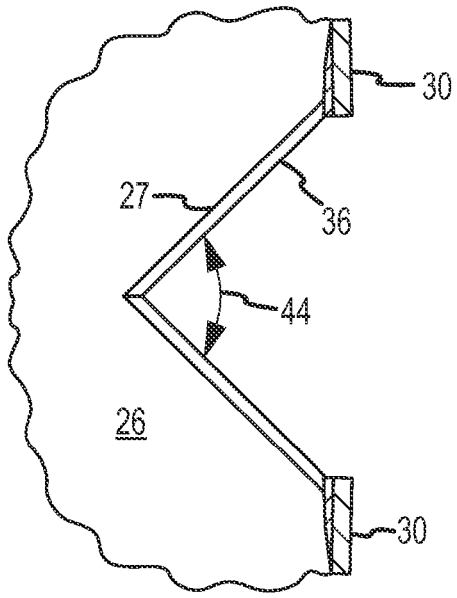
FIG. 7 is a close-up cross-sectional view of a liner of the CEFP warhead of FIG. 3 in accordance with another exemplary embodiment.

The CEFP warhead 20 further comprises a plurality of liners 36. Each liner is positioned within one of the circular openings 32 of the housing 30 and is embedded, pressed or otherwise positioned against a concave, recessed dimple 25 of the surface 27 of the main explosive charge 26. Each liner further comprises an axis 50 that extends through a center point 52 of the liner, to the center point 54 of the CEFP warhead 20, and is uniaxial with the axis 31 of the dimple 25 within which it resides. In this regard, the liners may be but are not necessarily uniformly spaced from each other, are centered within the dimples 25 of the explosive charge 26, and are of a size such that they do not overlap. FIG. 6 is a side cross-sectional close-up view of the liner 36 embedded against the main explosive charge 26. A retaining ring or similar retainer 38 may be used to retain the liner within the housing 30. In one exemplary embodiment, as in the case of an explosive charge penetrator geometry (EFP geometry), the liner has an arc-shaped geometry, as illustrated in FIG. 6. The arc can have an apex angle 41 of from about 130 to about 175 degrees. The liner can range in diameter depending on armor penetration depth requirements but is no less than twice a predetermined penetration depth and no more than ⅓ the main explosive charge diameter. The liner thickness may be in the range of about 3% to about 5% of the main explosive charge diameter. In another exemplary embodiment, as in the case of a shaped-charge (SC) geometry, the liner has a trumpet geometry or, as illustrated in FIG. 7, a conical geometry, having an apex angle designated by double-headed arrow 44. The apex angle may be in the range of about 15 to about 125 degrees. The liner may be made of any suitable ductile, dense metal material. The penetration of the liner through re-enforced military armor steel is proportional to the density of the material from which it is made. Examples of suitable materials include copper, molybdenum, tungsten, aluminum, tantalum, depleted uranium, lead, tin, cadmium, cobalt, magnesium, titanium, zinc, zirconium, beryllium, nickel, silver, or any combinations, thereof. Alternatively, the liner may be made from rhenium, palladium or combinations thereof, as set forth in the U.S. application entitled "Improved Liners for Warheads and Warheads Having Improved Liners," filed on the same date as this disclosure and co-owned by the assignee of this disclosure.

Figure 8:
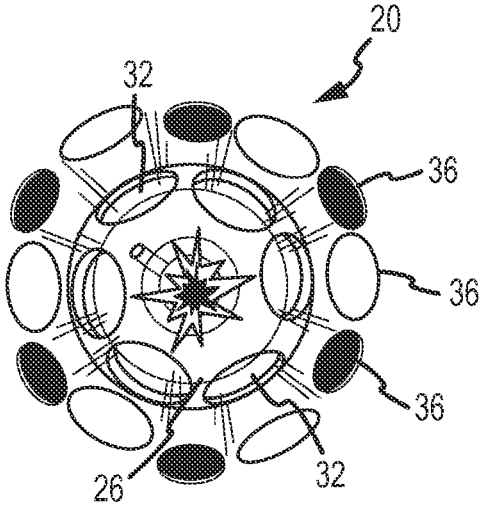
FIG. 8 is a perspective view of the CEFP warhead of FIG. 3 upon detonation.
Figure 9:
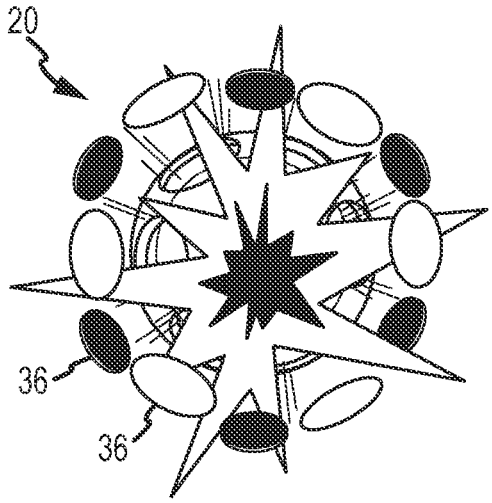
FIG. 9 is a perspective view of the CEFP warhead of FIG. 3 upon FIG. 8.
Figure 10:
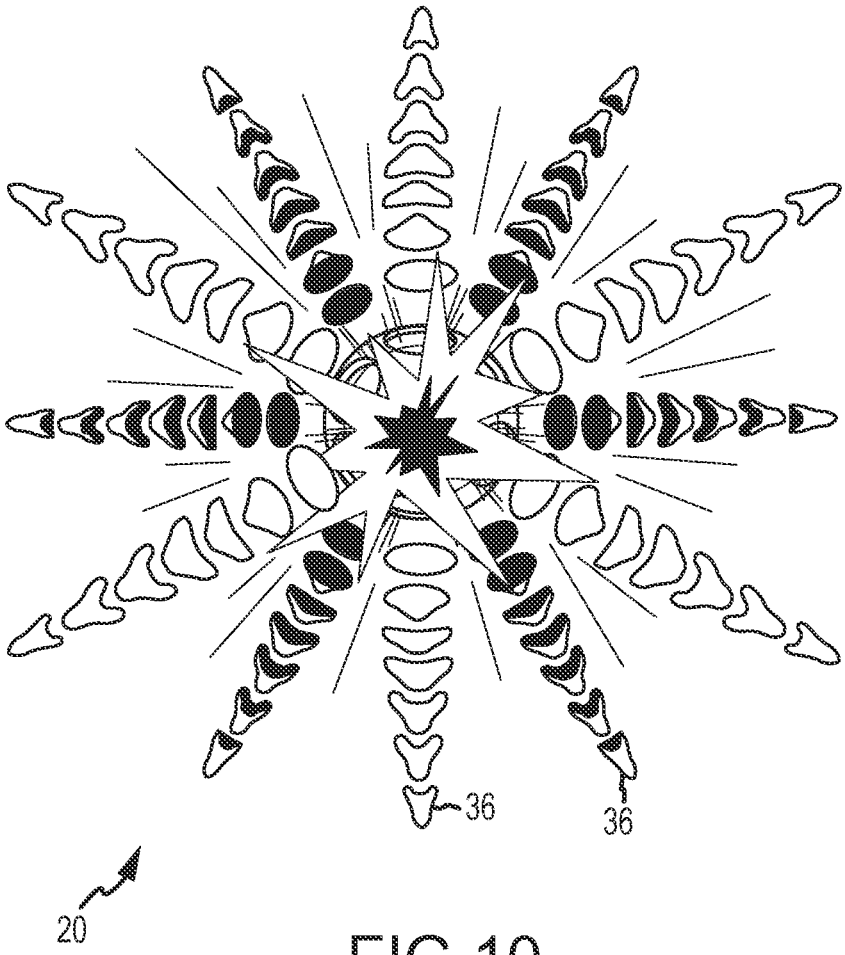
FIG. 10 is a perspective view of the CEFP warhead of FIG. 3 after FIG. 9 with the liners forming hyper-velocity slugs.

FIGS. 8-10 illustrate the CEFP warhead 20 following detonation. Detonation of the initiator 22 by the fuze component system 24 generates a shock wave in the booster charge 28 that travels through the main explosive charge 26. Upon the violent initiation of the main explosive charge 26, the liners 36 are expelled forward in a 360 degree spread. As illustrated in FIG. 10, the liners collapse upon themselves and invert, transforming into carrot-shaped penetrator jets of molten metal slugs. The penetrator jets travel at hypervelocity speeds. For example, the penetrators can travel at speeds of 9 to 10 kilometers per second. The kinetic energy of the penetrator/slug is a product of the mass of the material that forms the penetrator/slug and the velocity of the penetrator/slug. Such shaped devices are effective penetrators of targets formed from single or multiple layers of materials such as rolled steel, ceramic, or composite armors. Because the explosive charge projects the liners, at hypervelocity, in a 360 degree direction, the hypervelocity penetrators/slugs can pierce armors of land, air, and sea vehicles substantially simultaneously.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A spherically-shaped explosive device comprising:

an initiator;

a fuze component system configured to ignite the initiator;

a substantially spherical explosive charge encasing the initiator, the substantially spherical explosive charge having a substantially spherical surface with a plurality of dimples formed thereon;

a housing surrounding the substantially spherical explosive charge and having a plurality of openings respectively corresponding in position to each of the plurality of dimples; and a plurality of liners respectively positioned on the substantially spherical surface of the substantially spherical explosive charge within corresponding ones of the plurality of dimples and corresponding ones of the plurality of openings, an outer edge of each liner registering with an interior facing surface of the housing at an inner edge of the housing at each corresponding opening.

2. The spherically-shaped explosive device of claim 1, wherein the openings are circular.

3. The spherically-shaped explosive device of claim 1, further comprising a retainer disposed between the outer edge of each liner and the inner edge of the housing at each corresponding opening.

4. The spherically-shaped explosive device of claim 1, wherein the spherically-shaped explosive device has a center point, wherein each of the plurality of liners has a liner center point and a central axis that extends through the liner center point to the center point of the spherically-shaped explosive device, and wherein the central axis of each of the plurality of liners only intersect at the center point of the spherically-shaped explosive device.

5. The spherically-shaped explosive device of claim 1, wherein each of the plurality of liners has an arc-shaped geometry.

6. The spherically-shaped explosive device of claim 5, wherein a diameter of each of the plurality of liners is no less than about twice a predetermined penetration depth and no more than ⅓ of a diameter of the substantially spherical explosive charge.

7. The spherically-shaped explosive device of claim 5, wherein a thickness of each of the plurality of liners is in the range of about 3% to about 5% of a diameter of the substantially spherical explosive charge.

8. The spherically-shaped explosive device of claim 5, wherein each of the plurality of liners has an apex angle in a range of about 130 to about 175 degrees.

9. The spherically-shaped explosive device of claim 1, wherein each of the plurality of liners has a conical geometry.

10. The spherically-shaped explosive device of claim 9, wherein each of the plurality of liners has an apex angle in a range of about 15 to about 125 degrees.

11. The spherically-shaped explosive device of claim 1, wherein each of the plurality of liners comprises a material selected from a group consisting of copper, molybdenum, tungsten, aluminum, tantalum, depleted uranium, lead, tin, cadmium, cobalt, magnesium, titanium, zinc, zirconium, beryllium, nickel, silver, and combinations thereof.

12. The spherically-shaped explosive device of claim 1, wherein the substantially spherical explosive charge comprises a PBX composition comprising octanitrocubane homogeneously dispersed within a binder matrix.

13. A cluster explosively-formed penetrator (CEFP) warhead comprising:

a spherically-shaped explosive charge having a substantially spherical surface comprising a plurality of non-overlapping dimples;

a housing surrounding the substantially spherical explosive charge and having a plurality of openings respectively corresponding in position to each of the plurality of dimples and each of the plurality of openings; and a means for detonating the spherically-shaped explosive charge; and a plurality of liners, each liner embedded in one of the plurality of non-overlapping dimples, an outer edge of each liner registering with an interior facing surface of the housing at an inner edge of the housing at each corresponding opening.

14. The CEFP warhead of claim 13, wherein the openings are circular.

15. The CEFP warhead of claim 13, wherein each of the plurality of liners has an arc-shaped geometry.

16. The CEFP warhead of claim 15, wherein a thickness of each of the plurality of liners is in the range of about 3% to about 5% of a diameter of the substantially spherical explosive charge.

17. The spherically-shaped explosive device of claim 15, wherein each of the plurality of liners has an apex angle in a range of about 130 to about 175 degrees.

18. The CEFP warhead of claim 13, wherein each of the plurality of liners has a conical geometry.

19. The CEFP warhead of claim 18, wherein each of the plurality of liners has an apex angle in a range of about 15 to about 125 degrees.

20. A warhead comprising:

an initiator;

a fuze component system configured to ignite the initiator;

a spherically-shaped explosive charge encasing the initiator and having a center point, the spherically-shaped explosive charge comprising a substantially spherical surface and a PBX composition comprising octanitrocubane homogeneously dispersed within a binder matrix;

a booster charge interposed between the initiator and the spherically-shaped explosive charge;

a housing surrounding the substantially spherical explosive charge and having a plurality of openings; and a plurality of non-overlapping liners disposed on the substantially spherical surface of the spherically-shaped explosive charge, each of the plurality of non-overlapping liners having a central axis that extends through the center point of the spherically-shaped explosive charge and an outer edge that registers with an interior facing surface of the housing at an inner edge of the housing at each corresponding opening.

* * * * *